US008458936B2

(12) United States Patent
Thorpe et al.

(10) Patent No.: US 8,458,936 B2
(45) Date of Patent: Jun. 11, 2013

(54) COLLAPSIBLE FABRIC DISPLAY STRUCTURE

(75) Inventors: Hilton Ralph Thorpe, KwaZulu-Natal (ZA); John Walter Bailey, KwaZulu-Natal (ZA)

(73) Assignee: Sunsmart Products (Pty) Ltd (ZA)

( * ) Notice: Subject to any disclaimer, the term of this patent is extended or adjusted under 35 U.S.C. 154(b) by 0 days.

(21) Appl. No.: 12/863,520

(22) PCT Filed: Jan. 16, 2009

(86) PCT No.: PCT/ZA2009/000004

§ 371 (c)(1),
(2), (4) Date: Sep. 9, 2010

(87) PCT Pub. No.: WO2009/092119

PCT Pub. Date: Jul. 23, 2009

(65) Prior Publication Data

US 2010/0325927 A1 Dec. 30, 2010

(30) Foreign Application Priority Data

Jan. 17, 2008 (ZA) ..... 2008/00713

(51) Int. Cl.
*G09F 17/00* (2006.01)

(52) U.S. Cl.
CPC ..... *G09F 17/00* (2013.01)
USPC ..... 40/603; 40/610; 40/604

(58) Field of Classification Search
USPC ..... 40/603, 317, 604, 610; 135/123, 135/139, 141, 147, 20.3, 25.33, 907; 160/377, 160/388, 382
See application file for complete search history.

(56) References Cited

U.S. PATENT DOCUMENTS

| | | | | | |
|---|---|---|---|---|---|
| 523,293 | A | * | 7/1894 | Smith | 40/317 |
| 1,185,462 | A | * | 5/1916 | Emerson | 292/46 |
| 1,194,610 | A | * | 8/1916 | Fischer | 40/603 |
| 1,636,594 | A | * | 7/1927 | Dickey | 135/98 |
| 3,167,081 | A | * | 1/1965 | Higgins | 135/98 |
| 3,213,868 | A | * | 10/1965 | Forbes | 135/98 |
| 4,558,862 | A | * | 12/1985 | Kelly | 473/176 |

(Continued)

*Primary Examiner* — Joanne Silbermann
*Assistant Examiner* — Christopher E Veraa
(74) *Attorney, Agent, or Firm* — Grossman Tucker Perreault & Pfleger PLLC

(57) ABSTRACT

A collapsible fabric display system comprises a frame and a fabric membrane configured for securement to the frame, which includes a hollow tubular spine and a pair of opposed fabric spreaders attached to the spine—the spreader being located within the spine. The spreaders are movable along the spine under urging of a spreader drive mechanism between a retracted condition of the frame in which the spreaders are located proximate one another, and an extended condition of the frame (illustrated) in which the spreaders are remote from one another. The spreaders each comprise a hub mounted on the spine and a plurality of spreader ribs pivotably connected to each hub, made up of a set of internal ribs and a set of external ribs. The free ends of the ribs are configured for connection to the fabric in use and the use of two sets of three ribs give the display an A-frame configuration. The fabric membrane is a double-sided sheet with anchor points for the free ends of the spreader ribs that correspond to the extremities of the fabric. At the base of the structure, the anchor points define feet, each having a fabric pocket that provides an anchor point for the free ends for a pair of ribs. The free ends of the remaining ribs fit into fabric pockets located within the opposed apices of the resultant A-shaped display structure.

4 Claims, 3 Drawing Sheets

U.S. PATENT DOCUMENTS 5,347,737 A * 9/1994 Theobald, III ..... 40/610
5,573,028 A * 11/1996 van der Stigohel ..... 135/147
6,332,284 B1 * 12/2001 Tafforeau ..... 40/603
6,454,227 B1 * 9/2002 LaMotte ..... 248/165
7,424,864 B2 * 9/2008 McCann ..... 116/174
7,556,053 B2 * 7/2009 Hansen ..... 135/114

* cited by examiner

COLLAPSIBLE FABRIC DISPLAY STRUCTURE

TECHNICAL FIELD

This invention relates to a collapsible fabric display structure and a display system using such a structure that finds preferred but not exclusive application in advertising and related fabric display systems.

These display systems typically comprise a demountable frame that supports a fabric membrane which carries the material to be displayed, normally advertising or information printed or otherwise incorporated on or into the fabric.

Examples of such systems include A-frame and other structures in which a pipe- or other frame is used to support a fabric banner.

BACKGROUND ART

Collapsible fabric display systems typically comprise a demountable frame that supports a fabric membrane which carries the material to be displayed, normally advertising or information printed or otherwise incorporated on or into the fabric.

Examples of such systems include simple A-frame and other structures in which a pipe- or other frame is used to support a fabric banner.

The disadvantages of such systems have long been realised and display structures have since been developed to which the technology of architectural tensile structures has been applied to provide displays in which the fabric membrane is kept in tension to enhance the readability of the display and in which the structural members are adapted to counter the fabric tension to enhance the integrity and stability of the structure. Examples of such tensile collapsible fabric display systems include so-called pop-up or folding banners, normally A-framed banners, that use coiled spring steel framing members to tension the fabric membrane.

It is to these tensile structures that this invention relates since, in essence the display system of this invention is a tensile structure, even though the display structures described as examples of this invention are not necessarily architectural structures.

Existing tensile collapsible fabric display systems and pop-up or folding A-frame systems in particular are normally simple to erect but notoriously difficult to disassemble, the sprung frames making it virtually impossible for anyone but an experienced person to fold up and stash into the carry bag normally provided.

This invention seeks to address this shortcoming.

DISCLOSURE OF INVENTION

A collapsible fabric display system according to this invention comprises a frame and a fabric membrane adapted for securement to the frame:

- the frame comprising a spine, at least one fabric spreader attached to the spine and spreader drive means;
- the or each spreader being movable along the spine under urging of the spreader drive means between a retracted condition and an extended condition of the frame;
- the or each spreader comprising a hub mounted on the spine and at least one spreader rib pivotably connected to the hub, the free end of the or each rib being adapted for connection to the fabric in use;
- the pivot connection of each rib to its hub being adapted to permit pivoting of the rib relatively to the spine, between a retracted position of the rib in which the rib is pivoted into a retracted position in which the rib is parallel with the principal axis of the spine, and an extended condition of the rib, in which the rib is pivoted outwardly and the free end of the rib extends radially away from the spine;
- the or each spreader being adapted, when, in use, the free end of the or each rib is connected to the fabric and the spreader drive means is operated to move each spreader from its retracted condition to its extended condition, to permit pivoting of the rib relatively to the spine to the extended condition of the rib in which the rib extends radially outwardly and the free end of the rib is adapted to tension the fabric membrane connected to the free end of the rib; and
- the or each spreader being adapted, when, in use, the spreader drive means is operated to move each spreader to its retracted condition from its extended condition, to permit pivoting of the or each rib relatively to the spine to the retracted condition of the rib in which the rib is parallel with the principal axis of the spine and the free end of each rib is adapted to release the tension on the fabric membrane connected to the free end of the rib.

The collapsible fabric display system may conveniently have a frame comprising a spine and at least two opposed fabric spreaders attached to the spine and spreader drive means:

- the spreaders being movable along the spine under urging of the spreader drive means between a retracted condition of the frame in which the spreaders are located proximate one another and an extended condition of the frame in which the spreaders are remote from one another;
- the spreaders each comprising a hub mounted on the spine and at least one spreader rib pivotably connected to the hub, the free end of the or each rib being adapted for connection to the fabric in use;
- the pivot connection of each rib to its hub being adapted to permit pivoting of the rib relatively to the spine, between a retracted position of the rib in which the rib is pivoted into a retracted position in which the rib is parallel with the principal axis of the spine, and an extended condition of the rib, in which the rib is pivoted outwardly and the free end of the rib extends radially away from the spine;
- the spreaders being adapted, when, in use, the free end of the or each rib is connected to the fabric and the spreader drive means is operated to move the spreaders from their retracted condition to their extended condition remote from one another, to permit pivoting of the rib relatively to the spine to the extended condition of the rib in which the rib extends radially outwardly and the free end of the rib is adapted to tension the fabric membrane connected to the free end of the rib; and
- the spreaders being adapted, when, in use, the spreader drive means is operated to move the spreaders to their retracted condition proximate one another from their extended condition, to permit pivoting of the or each rib relatively to the spine to the retracted condition of the rib in which the rib is parallel with the principal axis of the spine and the free end of each rib is adapted to release the tension on the fabric membrane connected to the free end of the rib.

The collapsible fabric display system of the invention may conveniently include a plurality of ribs and to this end:

- the frame may comprise a spine and at least two opposed fabric spreaders attached to the spine and spreader drive means;

one or both spreaders being movable along the spine under urging of the spreader drive means between a retracted condition of the frame in which the spreaders are located proximate one another and an extended condition of the frame in which the spreaders are remote from one another;

the spreaders each comprising a hub mounted on the spine and a plurality of spreader ribs pivotably connected to the hub, the free ends of the ribs being adapted for connection to the fabric in use;

the pivot connection of the ribs to the hubs being adapted to permit pivoting of the ribs relatively to the spine, between a retracted position of the ribs in which the ribs are pivoted into retracted positions in which the ribs are parallel with the principal axis of the spine, and an extended condition of the ribs, in which the ribs are pivoted outwardly and the free ends of the ribs extend radially away from the spine;

the spreaders being adapted, when, in use, the free ends of the ribs are connected to the fabric and the spreader drive means is operated to move the spreaders from their retracted condition to their extended condition remote from one another, to permit pivoting of the ribs relatively to the spine to the extended condition of the ribs in which the ribs extend radially outwardly and the free ends of the ribs are adapted to tension the fabric membrane connected to the free ends of the ribs; and the spreaders being adapted, when, in use, the spreader drive means is operated to move the spreaders to their retracted condition proximate one another from their extended condition, to permit pivoting of the ribs relatively to the spine to the retracted condition of the ribs in which the ribs are parallel with the principal axis of the spine and the free ends of the ribs are adapted to release the tension on the fabric membrane connected to the free ends of the ribs.

In the preferred form of this embodiment of the invention the spine is constituted by an open-ended hollow tube and both spreaders are movable along the spine under urging of the spreader drive means, the spreaders comprising internal and external hubs:

the internal hub being mounted slidably within the spine for movement along the spine under urging of the spreader drive means, between an extended condition of the frame in which the internal hub is located adjacent the open end of the spine and a retracted condition of the frame in which the internal hub is located within the spine, remotely of the open end of the tube;

the external hub being mounted slidably on the exterior of the spine for movement along the spine under urging of the spreader drive means, between an extended condition of the frame in which the external hub is located adjacent the open end of the spine and a retracted condition of the frame in which the external hub is located on the spine, remotely of the open end of the tube;

the spreader ribs connected to the internal hub having pivot connections to the hub that permit retraction of the ribs into the tubular spine when, in use, the internal hub is moved into the spine to the retracted condition of the frame under urging of the spreader drive means, the ribs being adapted to be drawn into the spine parallel with the principal axis of the spine; and the spreader ribs connected to the external hub having pivot connections to the hub that permit pivoting of the ribs against the exterior of the spine when, in use, the external hub is moved along the spine to the retracted condition of the frame under urging of the spreader drive means, the ribs being adapted to fold flat against the outside of the spine parallel with the principal axis of the spine.

The collapsible fabric display system of the invention may conveniently include three ribs mounted on each fabric spreader, with the ribs on the one spreader having matching ribs on the other that are axially aligned with one another, thereby to provide an A-frame for an appropriately configured fabric membrane.

The fabric anchor points for the free ends of the spreader ribs preferably correspond to the extremities of the fabric.

In the description of the invention given above, the ribs are described as having pivot connections, but in a simplified or miniaturised version of A-frame and other collapsible fabric display systems, the ribs may be rigidly mounted flexible ribs that bend rather than pivot.

BRIEF DESCRIPTION OF THE DRAWINGS

The invention will be further described with reference to the accompanying drawings in which.

BEST MODES FOR CARRYING OUT THE INVENTION

Figure 1:
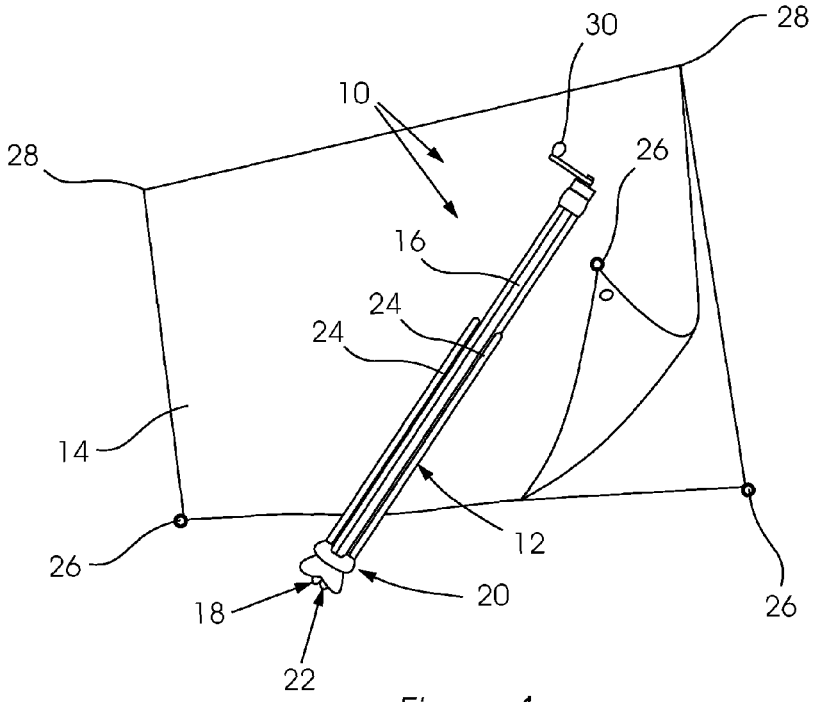
FIG. 1 is a diagrammatic plan view of the collapsible fabric display system of the invention in the retracted, collapsed condition thereof.

One embodiment of the collapsible fabric display structure and display system is illustrated in the accompanying drawings, but it will be appreciated that this is purely illustrative and the invention will find application in multiple applications.

Like typical collapsible fabric display systems, the collapsible fabric display system of the invention illustrated in the drawings comprises a collapsible or demountable frame that supports a fabric membrane which is printed or otherwise marked with the material to be displayed, normally advertising material. Unlike the simple pipe-based A-frame structures currently in use, the collapsible fabric display system of this invention consists of a proper tensile structure frame which maintains appropriate tension on the fabric membrane and moreover, a frame that permits disassembly of the display without the embarrassingly difficult process associated with current coiled frame folding A-frame banners.

Figure 2:
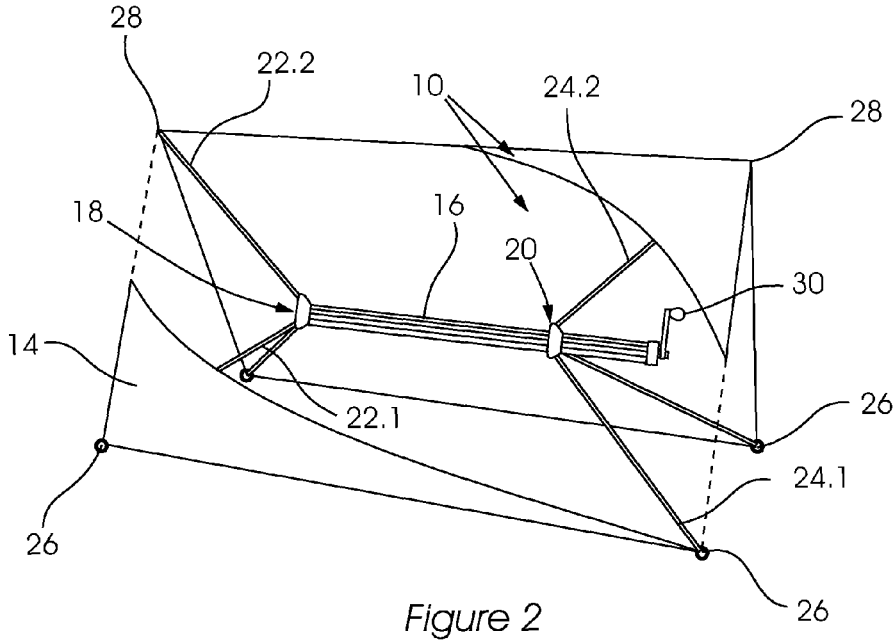
FIG. 2 is a diagrammatic isometric view of the collapsible fabric display system of FIG. 1 in the extended, erected condition thereof.

The basic components of the collapsible fabric display system 10 are illustrated in FIGS. 1 and 2 and comprise a frame 12 and a fabric membrane 14 adapted for securement to the frame 12.

The frame 12 includes a hollow tubular spine 16 and a pair of opposed fabric spreaders 18, 20 attached to the spine 16—the spreader 18 being located within the spine 16 as will be seen below. The spreaders 18, 20 are movable along the spine 16 under urging of a spreader drive mechanism (30—described below) between a retracted condition of the frame 12 (illustrated in FIG. 1) in which the spreaders 18, 20 are located proximate one another, and an extended condition of the frame 12 (illustrated in FIG. 2) in which the spreaders 18, 20 are remote from one another.

The spreaders 18, 20 each comprise a hub (described in more detail below) mounted on the spine and a plurality of spreader ribs pivotably connected to each hub. As will be described in more detail below, the spreader ribs are made up of a set of three internal ribs 22 and three external ribs 24. The free ends of the ribs 22, 24 are adapted for connection to the fabric 14 in use. In variations of the collapsible fabric display system of this invention, less than three ribs and even single-rib configurations of the system are envisaged, but only the three-rib version of the collapsible fabric display system 10 will be described in this example.

Referring to FIG. 2, it can be seen that the use of two sets of three ribs 22, 24 give the display 10 an A-frame configuration—with three ribs 22 on the one spreader 18 being matched with three corresponding ribs 24 on the other spreader 20 that are axially aligned with one another.

The fabric membrane 14 is a simple double-sided sheet with anchor points for the free ends of the spreader ribs 22, 24 that correspond to the extremities of the fabric. At the base of the structure, the anchor points define feet 26, each having a fabric pocket that provides an anchor point for the free ends 22.1, 24.1 for a pair of ribs 22, 24. The free ends 22.2, 24.2 of the remaining ribs 22, 24 fit into fabric pockets located within the opposed apices 28 of the resultant A-shaped display structure.

A spreader drive mechanism 30 is used to open and close the display system 10, that is to move the frame components and the spreaders 18, 20 between the retracted condition of the frame 16 illustrated in FIG. 1 and the extended condition of the frame 16 illustrated in FIG. 2 in which the spreaders 18, 20 and the ribs 22, 24 extend fully to keep the fabric membrane 14 under tension. In this regard, the tension need not be great and need simply be sufficient to maintain the structural stability of the display system 10 and to draw out any folds that might militate against the clear display of the display material on the fabric.

Figure 3:
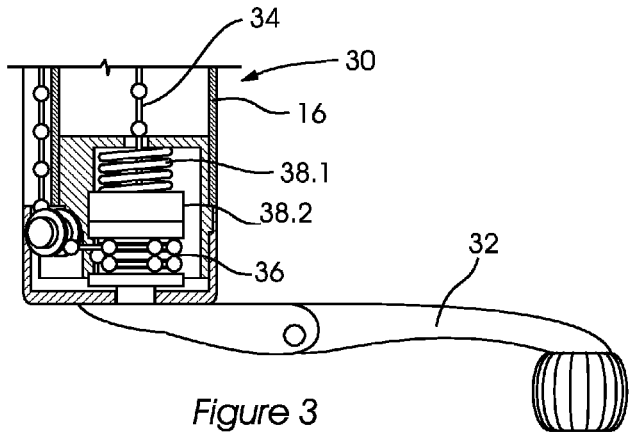
FIG. 3 is a sectional view on the spreader drive mechanism of the collapsible fabric display system.

The spreader drive mechanism 30 is illustrated in FIG. 3 and comprises a fold-away crank 32 that is used to draw a beaded rope 34 backwards and forwards by means of an appropriately recessed bead drive spool 36. The beaded drive rope 34 acts on the spreaders 18, 20.

Clockwise rotation of the crank 32 opens the display system 10—moves the spreaders 18, to the extended condition of the frame 16. Counter-clockwise rotation of the crank 32 closes the display system 10—moves the spreaders 18, 20 to the retracted condition of the frame 16.

In use, with the collapsible fabric display system 10 erected (FIG. 2), the fabric tension will tend to "unwind" the spool 36 (rotate the spool 36 counter-clockwise and retract the beaded rope 34).

A ratchet-like clutch 38 is used to prevent this from happening. The clutch 38 consists of a pair of opposed ratchet discs, constituted by a stop disc 38.1 and a freewheel disc 38.2. The stop disc 38.1 is spring-loaded to press its saw-toothed sides against the complementally toothed sides of the freewheel disc 38.2.

On clockwise rotation of the crank 32 the teeth of the freewheel disc 38.2 ride up and slip over the teeth of the stop disc 38.1. Unwanted counter-rotation of the freewheel disc 38.2 is prevented by the sprung engagement of the teeth of the stop disc 38.1 with the teeth of the freewheel disc 38.2, thereby to lock the freewheel disc 38.2, preventing the spool 36 from rotating counter-clockwise and retracting the beaded rope 34 and thereby preventing the unintended retraction or collapse of the erected collapsible fabric display system 10.

To close the display system 10—collapse the collapsible fabric display system 10 intentionally, the crank 32 is rotated counter-clockwise, which disengages the clutch 38 by pressing the stop disc 38.1 away from the freewheel disc 38.2. The crank 32 can now rotate the spool 36 counter-clockwise to retract the beaded rope 34, thereby causing retraction or collapse of the erected collapsible fabric display system 10.

As referred to above, the spreaders 18, 20 each comprise a hub mounted on the spine and a plurality of spreader ribs 22, 24 pivotably connected to each hub. The hubs include an internal hub 40, which is illustrated in more detail in FIGS. 4 to 6, and an external hub 41, which is illustrated in more detail in FIG. 6.

Figure 4:
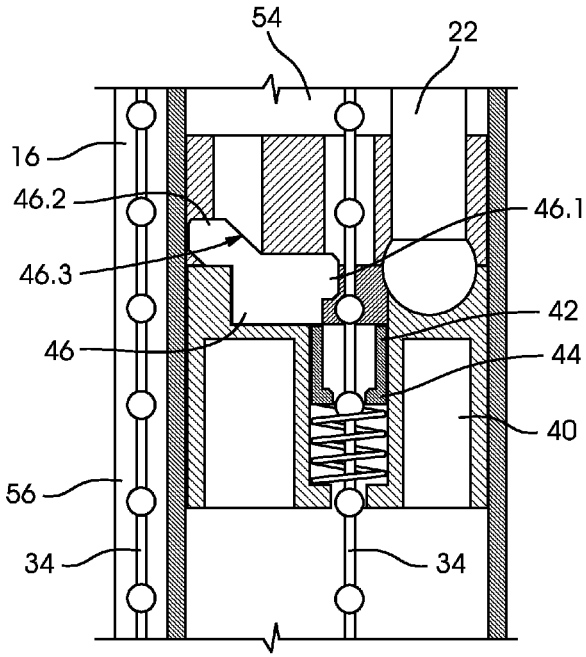
FIGS. 4 to 6 are sectional views illustrating the operation of the collapsible fabric display system of the invention.

Referring to FIG. 4, the spreader 18 includes an internal hub 40 and three internal ribs 22 secured to the internal hub 40 by means of ball and socket connections that permit the ribs 22 to pivot relatively to the hub 40. A driver 42, constituted by an enlarged bead or nub secured to the beaded rope 34, engages the internal hub 40 by means of a spring-loaded driver receiving cup 44 located within a complementally shaped bore in the internal hub 40 or by means of a locking plate 46 slidably mounted in the internal hub 40. During opening and closing of the display system 10, the driver 42 is trapped within the driver receiving cup 44 by means of the locking plate 46.

Using the orientation illustrated in FIG. 4, the display system 10 is opened by rotating the crank 32 clockwise, thereby drawing the beaded rope 34 upwardly against the driver 42 so that the driver 42 bears against the locking plate 46 and drags the internal hub 40 up with it.

During movement of the internal hub 40 within the hollow tubular spine 16, the internal ribs 22 are drawn into and out of the interior of the spine 16. An end cap 48 is fixed to the open end of the spine 16 point where the internal ribs 22 emerge from the spine 16. The end cap 48 is formed with three angled rib guides 50 that retain the internal ribs 22 at the correct angle when the display system 10 is open.

The end cap 48 is also formed with a profiled guide groove 52 for the beaded rope 34 that aligns with a complementary guideway 54 formed in the internal hub 40 at its one end. At its other end, the end cap guide groove 52 aligns with a complementary guideway 56 constituted by a profiled guide groove formed in the exterior of the spine 16.

Figure 5:
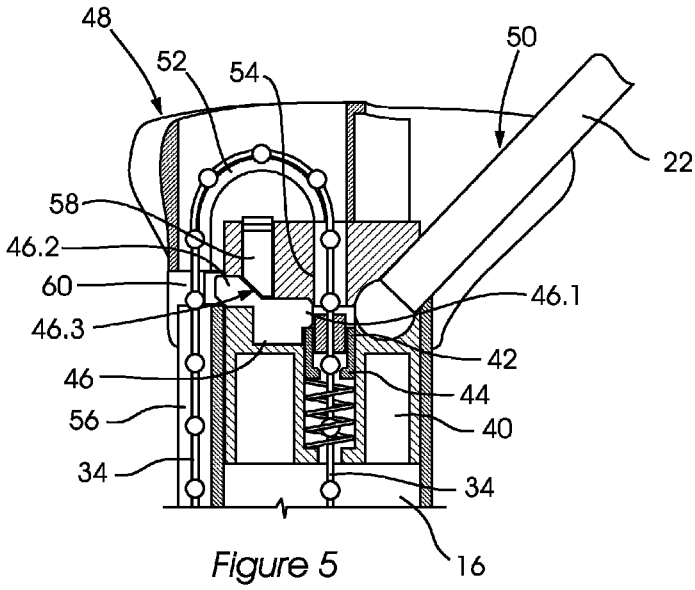

Using the orientation of FIG. 5, when the display system 10 is opened, the internal hub 40 is drawn upwardly and the internal ribs 22 are drawn outwardly by the fabric of the fabric membrane 14.

The complex shape of the locking plate 46 is determined by the functions it has to perform. The locking plate 46 includes a first, driver-engaging tab 46.1; a second, spine-engaging tab 46.2 and a beveled or angled upper end 46.3.

The end cap 48 includes an angled actuator pin 58 that is positioned to engage and interact with the angled upper end 46.3 of the locking plate 46. As the beaded rope 34 draws the internal hub 40 up against the end cap 48, sliding interengagement between the angled actuator pin and the angled upper end 46.3 of the locking plate causes the locking plate 46 to slide across—to the left, using the orientation of FIG. 5. This action slides the driver-engaging tab 46.1 of the locking plate 46 away from its engagement with the driver 42 so that further upward movement of the beaded rope 34 releases the driver 42 from the driver cup 44.

In addition, the spine-engaging tab 46.2 is moved into a gap formed between the upper end of the spine 16 and the underside of the end cap 48, thereby latching the internal hub 40 to the spine 16 in this position.

With the locking plate 46 in this position, the spring-loaded driver receiving cup 44 springs up to prevent the locking plate 46 from sliding back to the right, effectively locking the display system 10 in the open position. The driver-engaging tab 46.1 prevents the driver receiving cup 44 from springing out of the internal hub 40 (see FIGS. 5 and 6).

Figure 6:
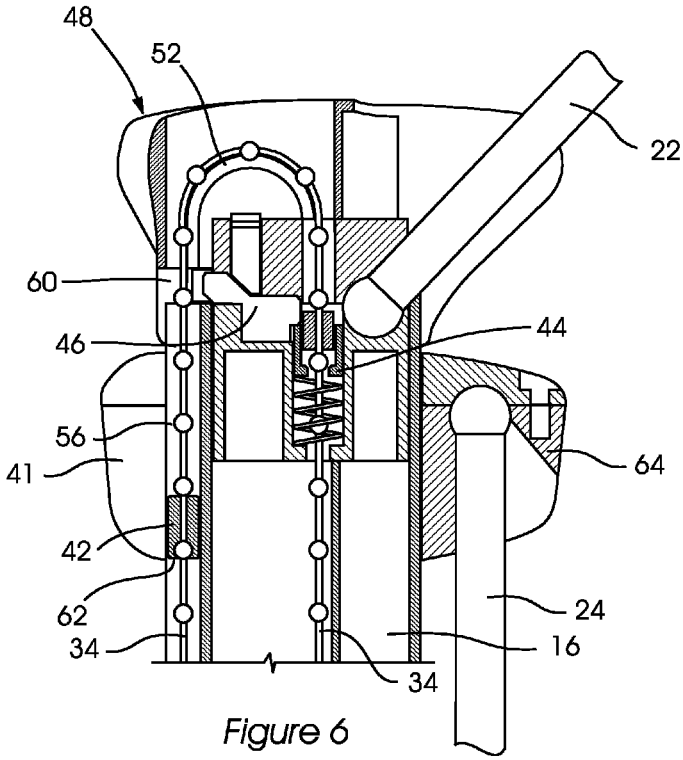

Referring now to FIG. 6, which illustrates the external hub 41 still located adjacent the end cap 48 at the open end of the spine 16, in which position the display system 10 is only partially open, with the external ribs 24 still folded up against the outside of the spine 16. From this position, further clockwise rotation of the crank 32 draws the beaded rope 34 and therefore the driver 42 up through the guide groove 52 in the end cap 48 and down through the guideway 56 in the spine 16.

The beaded rope 34 passes through an aperture 62 formed in the external hub 41, the aperture 62 being dimensioned to allow the beads of the beaded rope 34 to pass but not the driver 42. Further clockwise rotation of the crank 32 therefore draws the external hub 41 down with the moving driver 42 (using the orientation of FIG. 6). In the process the external ribs 24, which are pivotably mounted on the external hub 41 by means of ball and socket joints, are drawn by the fabric to pivot radially outwardly from the spine 16. The external hub 41 is formed with three angled rib guides 64 that retain the external ribs 24 at the correct angle when the display system 10 is open.

Once the spreaders 18, 20 reach the fully open position of the display system 10 (the extended condition of the frame 16 illustrated in FIG. 2) the spreaders 18, 20 and the ribs 22, 24 extend fully to keep the fabric membrane 14 under tension. In this position the operator stops rotating the crank 32 so that the clutch 38 can take and prevent the crank 32 from counter-rotating, thereby preventing the unintended retraction or collapse of the erected collapsible fabric display system 10.

To close the display system 10, the operator must rotate the crank 32 counter-clockwise against the spring resistance of the clutch release mechanism to permit continued counter-rotation of the crank 32.

The lower edge of the spine-engaging tab 46.2 is angled so that downward movement of the internal hub 40 will urge the locking plate 46 to the right (using the orientation of FIGS. 4 to 6). Of course, the locking plate 46 can only move in this way if the driver receiving cup 44 is moved out of its position of interference with the locking plate 46 (see FIG. 6) which is what happens upon the counter-clockwise (closing) rotation of the crank that draws the driver 42 upwardly (in FIG. 6) and out of engagement with the external hub 41. The driver 42 is drawn through the end cap 48, into the driver receiving cup 44 and the driver 42 then draws the driver receiving cup 44 downwardly out of the position in which it blocks the movement of the locking plate 46.

With the spine-engaging tab 46.2 of the locking plate 46 released, further downward movement of the driver 42 causes the driver and driver receiving cup 44 to draw the internal hub 40 downwardly and back to the position illustrated in FIG. 4.

Continued counter-clockwise rotation of the crank 32 will now withdraw the internal hub 40 and the internal ribs 22 into the spine 16 and detension the fabric membrane 14 which can now be disengaged from the frame 12 and folded away for storage. The external hub 41 is slid back manually on the spine 16 and the external ribs 24 are folded flat against the spine 16 for storage.

It will be appreciated that the opening and closing processes used in respect of the display system 10 of this invention are substantially simplified compared to those used with existing A-frame structures, obviating the need for the assembly of pipe frames that do not provide proper tension to the advertising banner or the embarrassment of not being able to disassemble and store coiled pop-up A-frame banners.

The invention claimed is:

1. A collapsible fabric display system comprising a frame and a fabric membrane configured for securement to the frame:

the frame comprising a spine, a spreader drive means and at least two opposed fabric spreaders attached to the spine and spreader drive means;

each fabric spreader being movable along the spine under urging of the spreader drive means between a retracted condition of the frame in which the spreaders are located proximate one another and an extended condition of the frame in which the spreaders are remote from one another;

each fabric spreader comprises a hub mounted on the spine and at least three spreader ribs pivotably connected to the hub, the free end of each rib being configured to connect to the fabric, the pivot connection of each rib to the hub being configured to permit pivoting of the rib relatively to the spine between a retracted position of the rib in which the rib is pivoted into a retracted position and the rib is parallel with a principal axis of the spine, and an extended condition of the rib, in which the rib is pivoted outwardly and the free end of the rib extends radially away from the spine;

each fabric spreader is configured to connect the free end of each rib to the fabric, and the spreader drive means is configured to move each fabric spreader from the retracted condition to the extended condition to permit pivoting of each rib relative to the spine to the extended condition of the rib in which the rib extends radially outwardly and the free end of the rib is configured to tension the fabric membrane connected to the free end of the rib; and wherein the spreader drive means is further configured to move each fabric spreader to the retracted condition from the extended condition to permit pivoting of each rib relative to the spine to the retracted condition of the rib in which the rib is parallel with a principal axis of the spine and the free end of each rib is configured to release the tension on the fabric membrane connected to the free end of the rib.

2. The collapsible fabric display system according to claim 1, wherein the spine is constituted by an open-ended hollow tube and each fabric spreader is movable along the spine under urging of the spreader drive means, the spreaders comprising internal and external hubs:

the internal hub being mounted slidably within the spine for movement along the spine under urging of the spreader drive means between an extended condition of the frame in which the internal hub is located adjacent the open end of the spine and a retracted condition of the frame in which the internal hub is located within the spine remotely of the open end of the tube;

the external hub being mounted slidably on the exterior of the spine for movement along the spine under urging of the spreader drive means between an extended condition of the frame in which the external hub is located adjacent the open end of the spine and a retracted condition of the frame in which the external hub is located on the spine remotely of the open end of the tube;

wherein the ribs on the internal hub are connected to the internal hub my means of pivot connections to the hub that permit retraction of each rib into the tubular spine when, in use, the internal hub is moved into the spine to the retracted condition of the frame under urging of the spreader drive means, each rib being configured to be drawn into the spine parallel with the principal axis of the spine; and wherein the ribs on the external hub are connected to the external hub by means of pivot connections to the hub that permit pivoting of each rib against the exterior of the spine when, in use, the external hub is moved along the spine to the retracted condition of the frame under urging of the spreader drive means, each rib being configured to fold flat against the outside of the spine parallel with the principal axis of the spine.

3. The collapsible fabric display system according to claim 1, wherein the ribs on the hub of one of the fabric spreaders are axially aligned with ribs on the hub of an opposing fabric spreader to provide an A-frame for an appropriately configured fabric membrane.

4. The collapsible fabric display system according to claim 3, wherein the fabric membrane is configured for securement to the frame at fabric anchor points positioned at extremities of the fabric membrane and wherein the free ends of the spreader ribs are configured to engage corresponding fabric anchor points.

* * * * *

UNITED STATES PATENT AND TRADEMARK OFFICE

CERTIFICATE OF CORRECTION

PATENT NO. : 8,458,936 B2
APPLICATION NO. : 12/863520
DATED : June 11, 2013
INVENTOR(S) : Hilton Ralph Thorpe et al.

It is certified that error appears in the above-identified patent and that said Letters Patent is hereby corrected as shown below:

In the Claims:

In column 8, line 64, in Claim 2, delete “my” and insert -- by --, therefore.

Signed and Sealed this
Twenty-fourth Day of September, 2013

Teresa Stanek Rea
*Deputy Director of the United States Patent and Trademark Office*